US007461845B2

(12) United States Patent
Montaldo et al.

(10) Patent No.: US 7,461,845 B2
(45) Date of Patent: Dec. 9, 2008

(54) MEMORY GAME AND METHOD OF PLAYING SAME

(75) Inventors: Stuart Montaldo, St. Louis, MO (US); Jennie Kretchmar, St. Louis, MO (US); Brett Kretchmar, St. Louis, MO (US)

(73) Assignee: DoubleStar, LLC, St. Louis, MO (US)

( * ) Notice: Subject to any disclaimer, the term of this patent is extended or adjusted under 35 U.S.C. 154(b) by 59 days.

(21) Appl. No.: 11/161,036

(22) Filed: Jul. 20, 2005

(65) Prior Publication Data

US 2007/0018394 A1 Jan. 25, 2007

(51) Int. Cl.
*A63F 1/00* (2006.01)

(52) U.S. Cl. ..... 273/273; 273/240; 273/302

(58) Field of Classification Search ..... 273/273, 273/292, 272, 296, 298, 299, 302, 308, 240
See application file for complete search history.

(56) References Cited

U.S. PATENT DOCUMENTS

| | | | | |
|---|---|---|---|---|
| 3,042,408 | A * | 7/1962 | Johnson | 273/271 |
| 5,190,296 | A * | 3/1993 | Sainsbury | 273/296 |
| 5,282,632 | A * | 2/1994 | Allen et al. | 273/302 |
| 5,887,873 | A * | 3/1999 | Freeman | 273/303 |
| 6,695,311 | B2 | 2/2004 | Yu et al. | 273/273 |
| 6,698,760 | B2 | 3/2004 | Francise | 273/273 |
| 6,746,017 | B2 | 6/2004 | Yu et al. | 273/273 |

* cited by examiner

*Primary Examiner*—William M Pierce
(74) *Attorney, Agent, or Firm*—Thompson Coburn LLP; Matthew A. Rosenberg

(57) ABSTRACT

A memory game is shown similar to the game of concentration. However, each tile has a coding region associated therewith for players to aid their memories with mnemonic codes. Additional variations are disclosed, including limiting which indicia may be matched and removed on a given turn and the use of a rummy-style removal of tiles using logically ordered indicia.

14 Claims, 6 Drawing Sheets

MEMORY GAME AND METHOD OF PLAYING SAME

BACKGROUND OF THE INVENTION

1. Field of the Invention

The present invention relates generally to memory-based card matching games, and more particularly to such a game where players may employ the aid of mnemonic coding.

2. Description of the Prior Art

It has been known in the past to play a memory-based card matching game commonly known as concentration. In concentration, a series of cards are provided with indicia located on one side thereof. Two cards (or at least an even number of cards) have matching indicia. The cards are placed in a playing area face down. Players take turns selecting two cards and turning them face up. If the indicia on the cards match, the player keeps the matching pair. If the indicia you do not match, the cards are turned face down again, and the next player selects two cards attempting to find matching indicia. The object of the game is to collect as many pairs of matching cards as possible. This is accomplished by using one's memory to track the location of previously exposed cards.

Concentration is a very simple game. However, it is the game's simplicity that causes players to lose interest in it over a relatively short period of time. New twists need to be added to make the game play a more exciting, competitive, and mentally challenging, and retain players' interest for a longer period of time. The other problem of concentration, is that little or no strategy is involved.

Thus, it is an object of the present invention to provide a memory-based card matching game with novel game playing differences.

It is a further object of the present invention to provide such a game with strategic elements.

SUMMARY OF THE INVENTION

It is with the above objects in mind that the present game was developed. The game uses a deck of cards or other tiles with indicia located on a front side. The deck actually comprises groups of tiles, and in the case of the preferred embodiment, they are pairs. Each pair (or group) has matching indicia. The backs of the tiles are used as a coding region for players to place mnemonic coding to aid them in remembering the location and/or details of previously exposed tiles.

In its simplest form, the present invention plays like concentration, except that after selecting two tiles without matching indicia, the player is permitted to place a coded mnemonic on the back of one of the tiles to aid him in remembering what was on the face of that tile, preferably using a code of his or her own design, that other players will not be able to decipher. In the preferred embodiment, only one of the selected tiles in a given turn is exposed to everyone and the other is only exposed to the player selecting it. The player then gets to place a mnemonic, which hopefully only he or she will understand, on the back of privately viewed tile.

Alternative embodiments of the present invention include new variations that add a modicum of strategy to the game. One addition involves the association of a characteristic to each indicium, and permitting the removal of a matched pair of tiles only on a turn when the associated characteristic is deemed "active." Subvariations on that include using wild-card indicia that are associated with any characteristic, and the use of a token given to each player at the start of the game to activate the next set of characteristics. Another addition rewards players for finding three consecutive pairs of matching indicia by permitting that player to take a matched pair from another player. Other tiles may be added that affect a player's or an opponent's coding.

Another alternative embodiment involves collecting tiles with a consecutive sequence of ordered indicia (e.g. a 2-3-4 tile run). This game would be more similar to traditional rummy with the addition of the coding element of the preferred embodiment.

Like traditional concentration, the game ends when all of the tiles have been matched. The player with the most pairs of tiles is declared the winner.

BRIEF DESCRIPTION OF THE DRAWINGS

So that the manner in which the above-identified features, advantages, and objects of the present invention are attained and can be understood in detail, a more particular description of the invention, briefly summarized above, may be had by reference to the embodiment thereof which is illustrated in the appended drawings.

It is noted however, that the appended drawings illustrate only a typical embodiment of this invention and is therefore not to be considered limiting of its scope, for the invention may admit to other equally effective embodiments. Reference the appended drawings, wherein.

DETAILED DESCRIPTION OF THE PREFERRED EMBODIMENT

Figure 1:
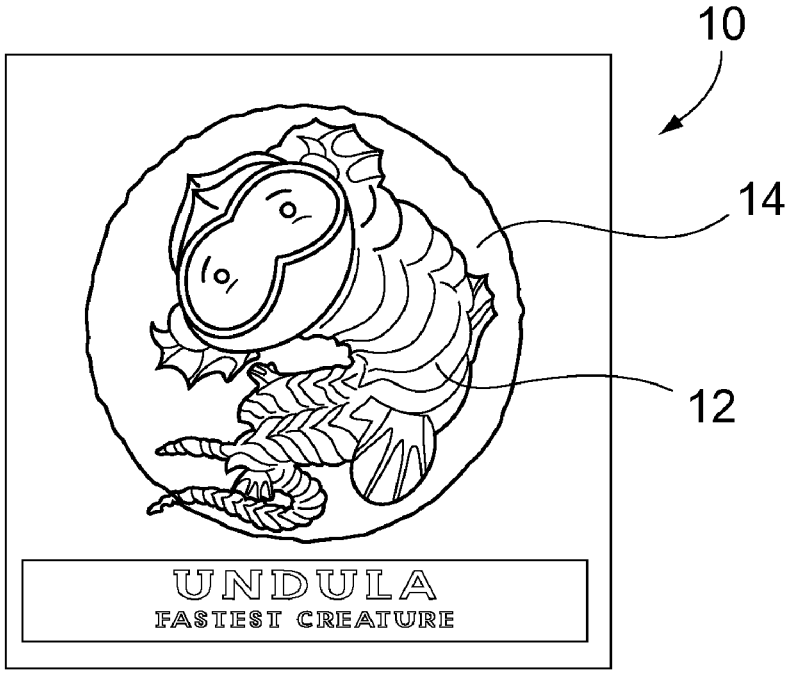
FIG. 1 is a drawing of a typical game playing tile according to the present invention.

The invention is a tile or card matching game, wherein the object is for the players to find, from memory, pairs of cards with matching indicia. Referring now to FIG. 1, the front (face) of a typical playing tile 10 is shown generally, with an indicium 12. Optionally, the face of the tile 10 also contains a characteristic icon 14 associated with the indicum 12. This is used to add an additional strategy element to the game, which will be explained in more detail below.

In the example shown in FIG. 1, the indicium 12 is a character named Undula™ from the Cogno® series of books and games from DoubleStar, LLC of St. Louis, Mo. In the background, behind Undula™ is the characteristic icon, which in this example is a drawing of a blue planet, which has been designated "Cold Planet"—meaning Undula™ can only live on a cold planet.

Figure 2:
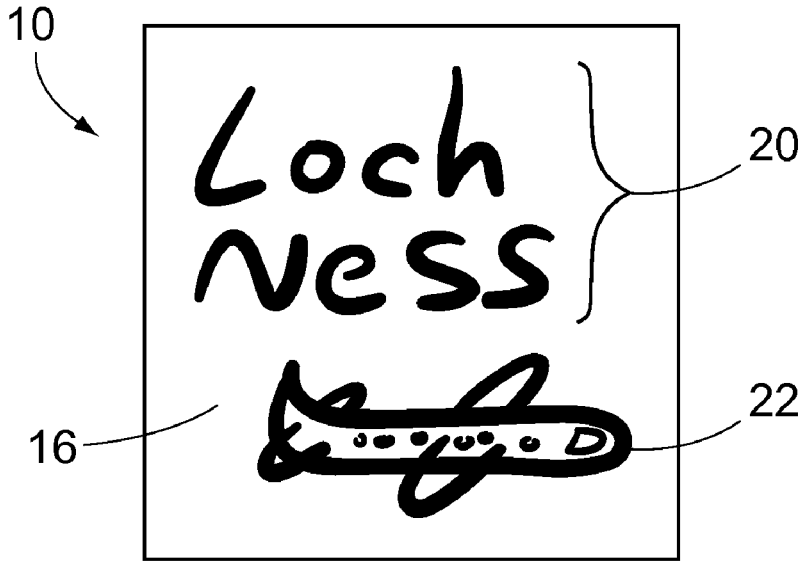
FIG. 2 is a drawing of the back side of the tile of FIG. 1, showing a mnemonic coding region.

Referring now to FIG. 2, the back of the tile 10 is designated as a coding area 16. Players are permitted to place a mnemonic code. The drawings show text and a symbol as codes, but, as will become apparent, any code can be used. The object of the code is to aid the player who placed the code to remember which indicium is on the front side thereof, while at the same time, not being too easily deciphered by competing players.

In the example shown in FIG. 2, two codes 20, 22 are shown. Although, the drawings are in black-and-white, it should be understood that in the preferred embodiment each player is assigned a different color for his or her codes. Thus, each player can know who wrote which codes. If the drawings were in color, it would be seen that code 20 is red, and code 22 is purple. Hypothetical Player 1 drew code 20. The words "Loch Ness" are intended to remind the player that Undula™ is the indicium on the other side. Those familiar with the Cogno® characters will understand that Undula™ is indigenous to water. Hypothetical Player 2 drew code 22, which is a pictograph of an airplane. Because Undula™ is the fastest creature in the universe, the jet plane (being a fast mode of transportation) is intended to remind Player 2 of Undula™.

Figure 6:
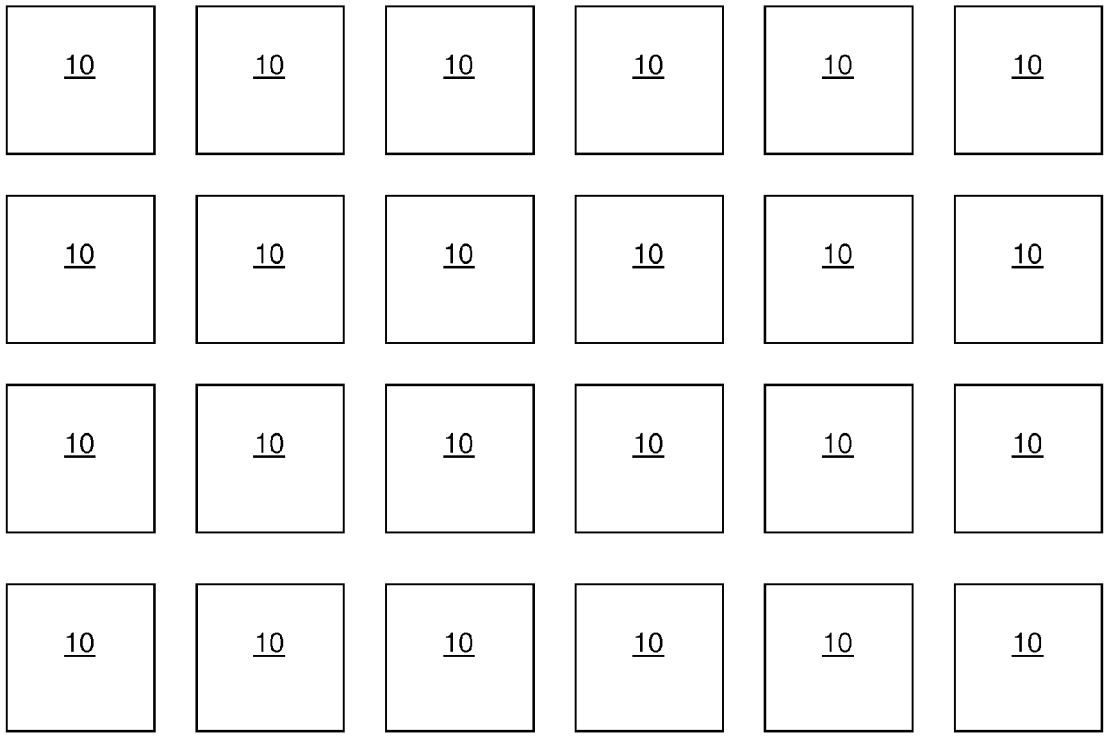
FIG. 6 is a depiction of a sample layout of the tiles of the present invention for game play.

In its most general form, the preferred embodiment is played as follows. A plurality of tiles 10 are arranged in a playing area, face down. FIG. 6 shows a typical arrangement of the tiles 10 in the playing area in a grid formation. The complete set of tiles comprises pairs of tiles with matching indicia 12 on the front thereof. Only the coding region 16 of the tiles is exposed. Game play is turn-based, with a player on his or her turn exposing one tile 10. He or she then tries to find a tile 10 with a matching indicium 12 to the first. If the indicia 12 match, the player keeps the matching pair (and in the preferred embodiment, is entitled to another turn). If the indicia 12 do not match, the tiles 10 are returned to the playing area face down in the same location. The player then has the opportunity if he or she wishes to place a mnemonic code in the coding region 16. In the preferred embodiment, the coding region 16 is a dry erase surface, and, as mentioned above, each player is given a dry erase marker 26 of a unique color, so that each player knows which codes belong to which players. Other coding devices are also possible. For instance, flexible members (e.g. pipe cleaners) of varying colors may be used by players to bend into coded shapes.

In some variations, it is possible to give another player an opportunity to code one or both tiles 10. In fact, in the preferred embodiment, the player to the right of the player whose turn it is, is permitted to code the first (exposed) tile 10, while the player whose turn it is, is coding the second (unexposed) tile 10.

Play then passes to the next player, who attempts to locate a matching pair in the same manner, by using his or her memory, his or her own codes, and/or any codes of opponents that he or she has deciphered (or thinks that he or she has deciphered). After all of the tiles have been matched, the player with the most sets of tiles 10 is declared the winner.

Players are not bound to keep a consistent coding schema. Each player is entitled to change his or her coding schema as often as he or she wishes during a game, and may even place intentionally inconsistent codes to deceive his or her opponents.

Figure 3:
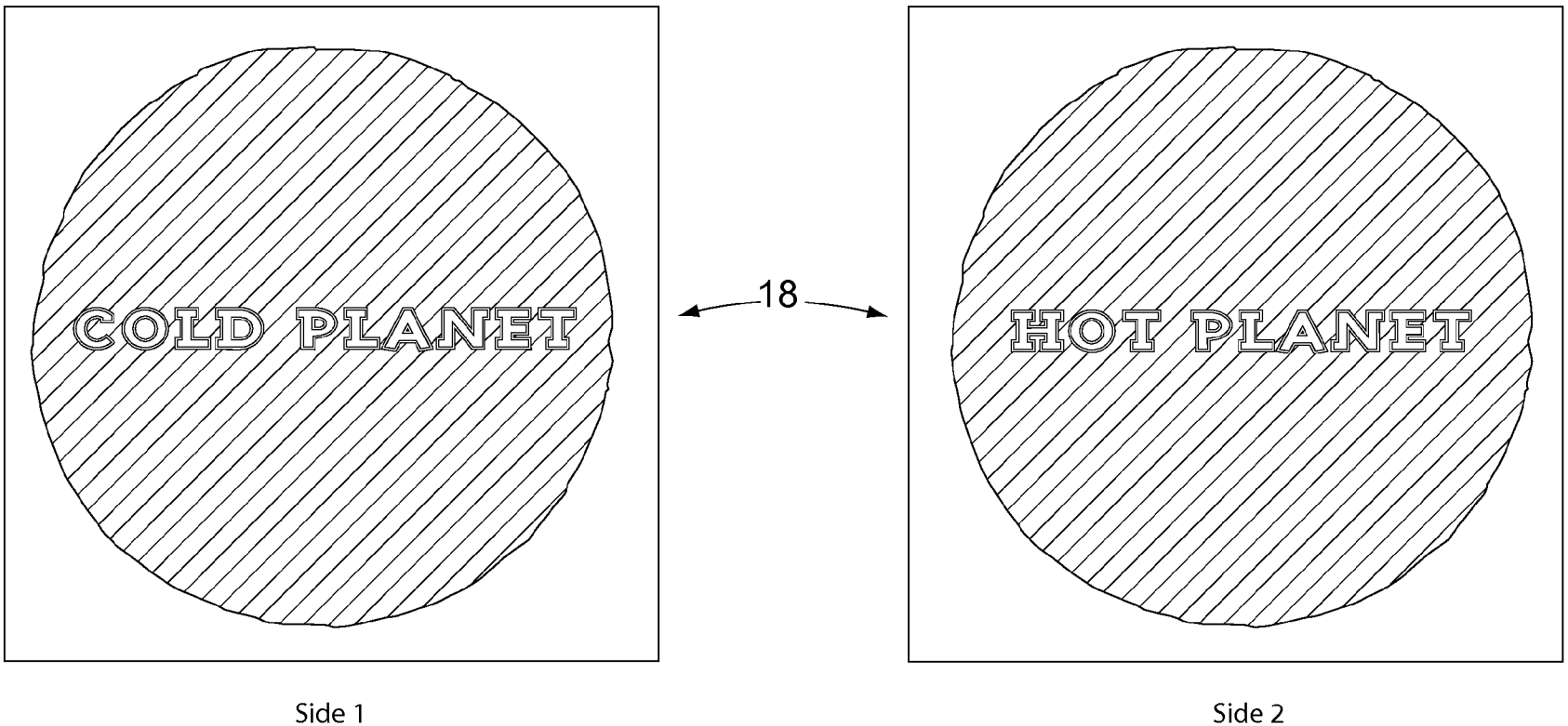
FIG. 3 is a drawing of a characteristics indicator for use with one embodiment of the present invention.
Figure 4:
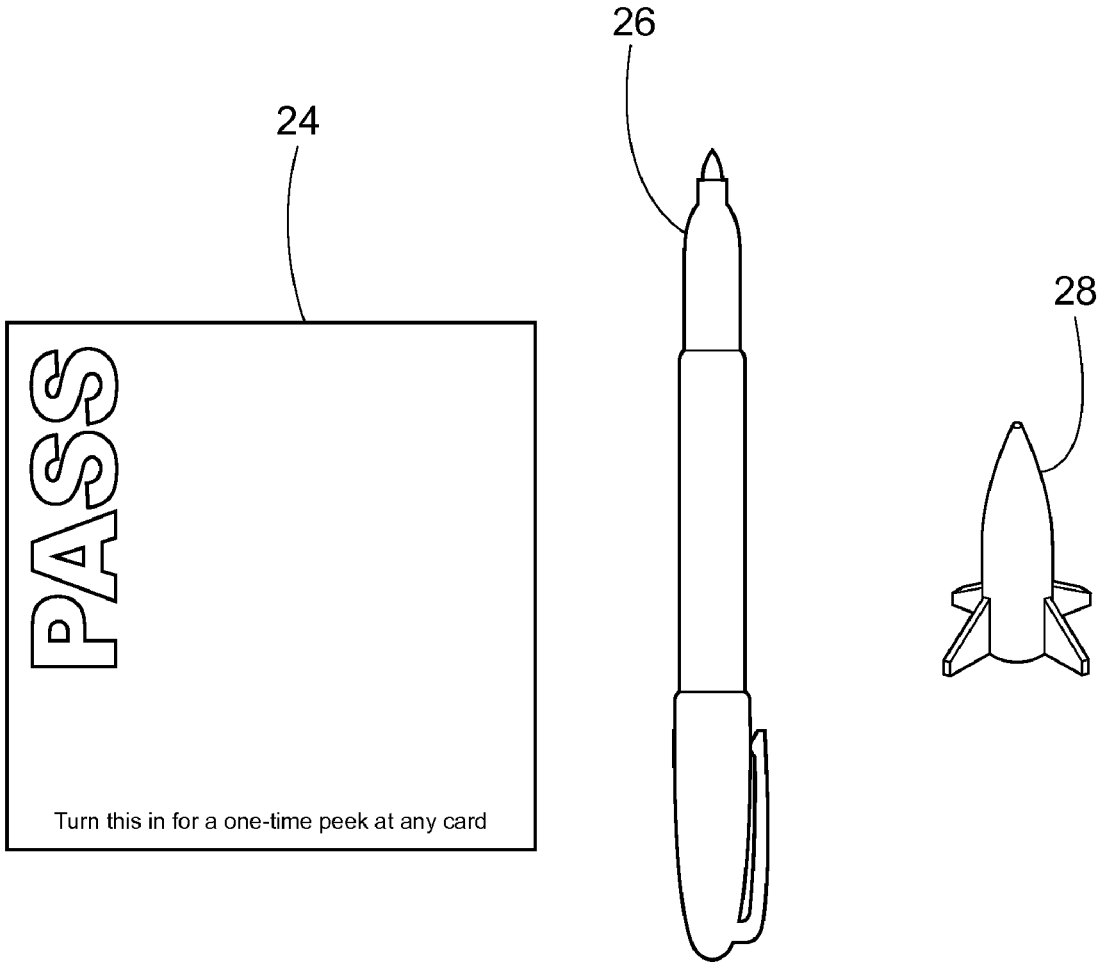
FIG. 4 is a rendering of miscellaneous equipment used for playing the game of the present of invention.
Figure 5:
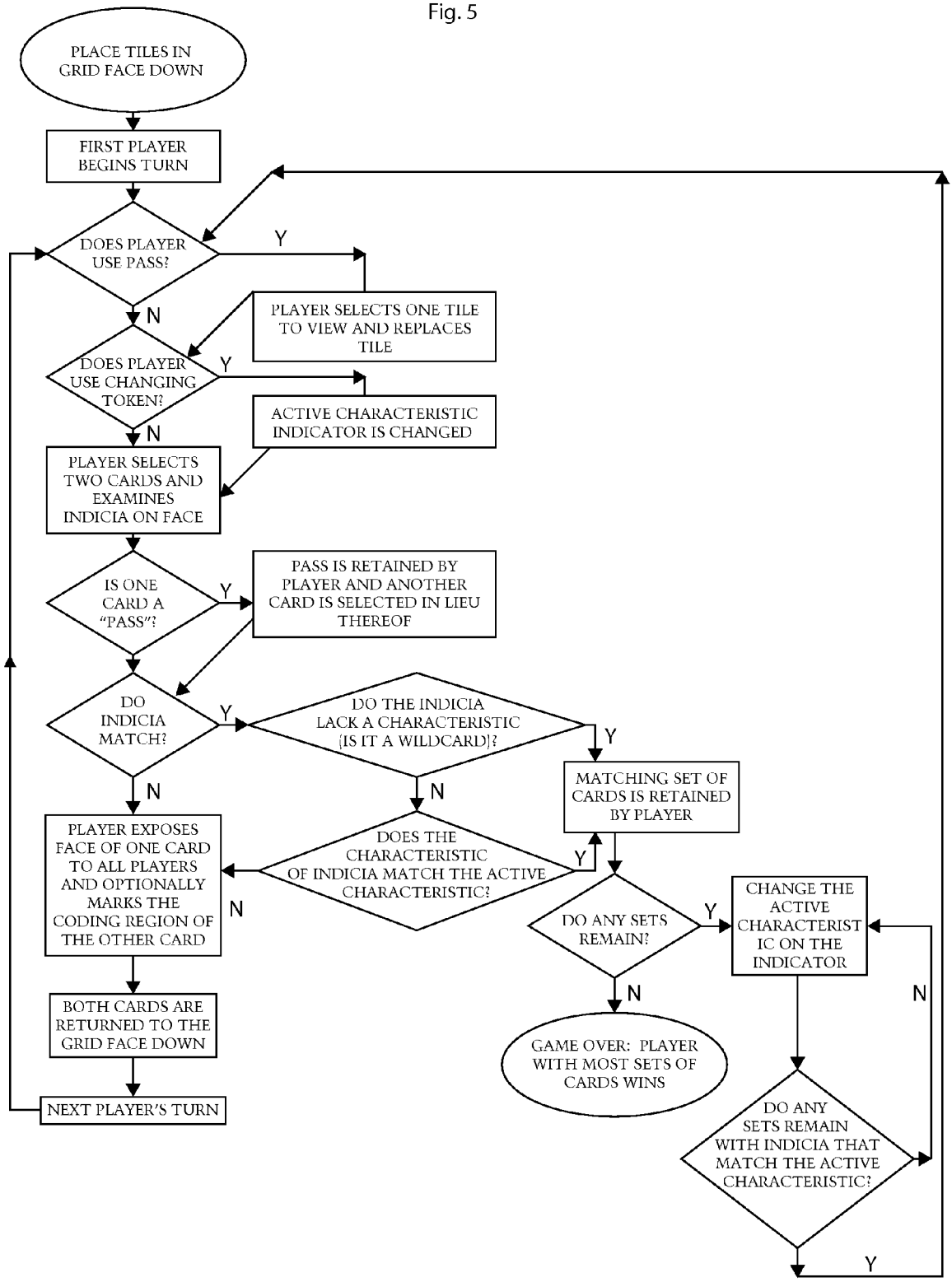
FIG. 5 is a flow chart showing the method of play for a preferred embodiment of the present invention.

Other variations of the preferred embodiment are possible to make game playing more interesting and to add additional strategic elements. In one such variation, characteristic icons 14 are included with each indicium. An indicator 18, as shown in FIG. 3, is used to keep track of which characteristics are eligible for removal from game play. If a matching pair of tiles 10 is found, the player may only keep the pair if the characteristic associated with the indicia 12 is designated that turn. If the characteristic is not designated that turn, the tiles 10 must be replaced to the playing area the same as if the indicia 12 did not match. Each time a pair of tiles 10 is removed, the indicator is changed to designate a new set of characteristics.

As shown in FIG. 3, the indicator may simply be made of a card with icons representing the characteristics being indicated on that turn. To change the indicator, the card is simply flipped over. FIG. 3 shows both sides of the indicator 18. On side 1, is a drawing of a blue planet, like the "Cold Planet" seen on the tile 10 of FIG. 1. On side 2, is a drawing of an orange planet, representing a "Hot Planet". Thus, in the examples shown in the Figures, if the indicator 18 was positioned with side 1 up, a player finding the two matching Undula™ tiles 10 could remove them from play. However, if side 2 of the indicator 18 was facing up, a player finding the two matching Undula™ tiles 10 would have to return them to the playing area because the characteristic associated with Undula™ (cold planet) does not match the characteristic on the indicator 18 (hot planet).

In an alternative embodiment, the indicator 18 can change every turn. In another alternative embodiment, each player is given a token 28 (or more than one) at the beginning of the game which can be redeemed to change the indicator 18 out of sequence. In yet another embodiment, one or more passes 24 are distributed randomly among the regular tiles 10. The pass 24 appears identical to the other tiles 10 on the back side, so that players will not be able to distinguish the pass 24 from the other tiles 10 until it is selected. When a player selects a pass 24 on his/her turn, he is entitled to use the pass on that or a subsequent turn to get a free look at any tile 10.

When using the characteristics indicator 18, certain indicia 12 are designated as wildcards—that is they have no associated characteristics. Thus, these wildcard tiles 10 may be removed when matched regardless of the status of the indicator 18. Indicia may be shown as wild cards by displaying no characteristics icon 14 therewith. In yet another embodiment, the tiles 10 are not removed when matched. Instead, the indicia 12 are arbitrarily ordered, and potentially numbers representing that order are located on the tiles 10 adjacent to the indicia 12. The object in this alternative embodiment is to find three tiles 10 with consecutively ordered indicia 12. In a subvariation thereof, a player who has found three consecutively ordered indicia 12, may at his or her option select a fourth tile 10 seeking an indicium 12 that would extend the consecutive run (either upward or downward). If, however, he or she did not find a tile 10 that extended the run, all of the tiles 10 selected on the turn would have to be replaced. If the run were extended, he or she may optionally risk all of the tiles 10 again by selecting an additional tile 10 in a further attempt to extend the run, and so forth. In this subvariation, the winner is the player collecting the most tiles.

The game may also be computerized. In a possible computer version, each player is located at a separate computer or terminal, connected by local area network (LAN) or the Internet. Each tile is an abstract computerized object, which can be exposed to only one player by displaying the indicium associated with the tile on the screen of that player. The coding regions in this version would not be on the physical backs of tiles, but would be logically associated with tiles in a one-to-one correspondence.

While the foregoing is directed to the preferred embodiments of the present invention, other and future embodiments of the invention may be devised without departing from the basic scope thereof, and the scope thereof is determined by the claims which follow.

What is claimed is:

1. A method of playing a game by a plurality of players comprising the steps of:

placing a plurality of pairs of tiles in a playing area, each pair of tiles having a front side with matching indicia thereon, and a back side, the tiles being placed front side down within the playing area;

taking turns among the players;

in each turn, selecting two tiles and examining the front sides thereof, one of which is exposed to all other players;

removing the tiles from play if the indicia on the two examined tiles match, the removed tiles to be retained by the player who selected them;

returning the tiles to the playing area if the indicia on the two examined tiles differ;

placing mnemonic coding on the back side of one or more of the examined tiles that were returned; and repeating the selecting-examining, removing, returning, and placing steps with each turn until all tiles have been removed from the playing area.

2. The method of playing a game of claim 1, wherein a player who finds a pair of tiles with matching indicia immediately takes another turn.

3. The method of playing a game of claim 2, wherein a player who finds three consecutive pairs of tiles with matching indicia may take for himself/herself a pair of tiles from any other player.

4. The method of playing a game of claim 1, wherein a characteristic is associated with each set of indicia, the method further comprising the steps of:

maintaining two or more characteristics indicators and an indicator token adapted to mark one of said characteristics indicators as active;

rotating the indicator token to mark the next characteristics indicator as active each time a pair of tiles is removed; and wherein tiles are only removed from play if the indicia on the two examined tiles match and the characteristic associated with those indicia further matches a characteristic on the active characteristics indicator.

5. The method of playing a game of claim 4, wherein one or more indicia are associated with a wildcard characteristic that automatically matches with any active characteristics indicator.

6. The method of playing a game of claim 4, further comprising the steps of:

supplying each player with one or more switching tokens; and permitting a player to use a switching token, prior to the selecting and examining step, such use causing the indicator token to immediately rotate to the next characteristics indicator.

7. The method of playing a game of claim 4, further comprising the steps of:

tracking the number of matching pairs of tiles removed for each characteristics indicator; and eliminating a characteristics indicator from the rotation when all pairs of tiles corresponding to that characteristics indicator have been matched and removed from play.

8. The method of playing a game of claim 1, further comprising the steps of:

including with the tiles, one or more passes that appear the same as the tiles from the back sides thereof;

permitting a player who selects a pass to keep it for later use at a time of his/her choosing; and allowing a player upon use of a pass to select and examine one tile before the normal selecting and examining of two tiles in the normal course of a turn.

9. The method of playing a game of claim 1, wherein the backside of the tiles are covered with an erasable surface, and the mnemonic coding is applied with an erasable marker.

10. The method of playing a game of claim 9, wherein each player is given a distinct color erasable marker for his/her own mnemonic coding.

11. The method of playing a game of claim 1, wherein the tiles are placed in a grid formation within the playing area.

12. A game for a plurality of players comprising:

a plurality of pairs of tiles, each pair of tiles having a front side with matching indicia thereon designed to be hidden from view, and a back side;

a coding region on the back side of each tile for players to apply mnemonic coding relating to the indicia of the tiles that an individual player has seen, said coding region comprising a surface material readily capable of being written upon and subsequently erased a plurality of times; and an ink marker suitable for use on said coding region.

13. The game of claim 12, further comprising a plurality of ink markers suitable for use on said coding region, each marker having a distinct color.

14. A method of playing a game by a plurality of players comprising the steps of:

placing a plurality of tiles in a playing area, each tiles having a front side with one or more indicia thereon, and a back side, the tiles being placed front side down within the playing area;

taking turns among the players;

in each turn, selecting a plurality of tiles and examining the front sides thereof, one of which is exposed to all other players;

removing the tiles from play if the indicia on the examined tiles meet a set of preselected criteria, the removed tiles to be retained by the player who selected them;

returning the tiles to the playing area if the indicia on the examined tiles do not meet said preselected criteria;

placing mnemonic coding on the back side of one or more of the examined tiles that were returned; and repeating the selecting-examining, removing, returning, and placing steps with each turn until all tiles have been removed from the playing area.

* * * * *